United States Patent [19]

Polis et al.

[11] Patent Number: 4,469,199

[45] Date of Patent: Sep. 4, 1984

[54] ELEVATOR SYSTEM

[75] Inventors: Marjorie J. Polis, Morristown; Linus R. Dirnberger, Randolph; Matthew F. Kersen, Union, all of N.J.

[73] Assignee: Westinghouse Electric Corp., Pittsburgh, Pa.

[21] Appl. No.: 387,302

[22] Filed: Jun. 10, 1982

[51] Int. Cl.[3] ..... B66B 3/02

[52] U.S. Cl. ..... 187/29; 340/19 R; 340/21

[58] Field of Search ..... 187/29 R

[56] References Cited

U.S. PATENT DOCUMENTS

| | | | |
|---|---|---|---|
| 2,938,603 | 5/1960 | Loughridge | 187/29 |
| 3,058,546 | 10/1962 | Caputo | 187/29 R |
| 4,114,729 | 9/1978 | Köhler | 187/29 R |
| 4,164,271 | 8/1979 | Bergström | 187/29 R X |
| 4,191,277 | 3/1980 | Meyer et al. | 187/29 R |
| 4,203,506 | 5/1980 | Richmon | 187/29 R |
| 4,375,249 | 3/1983 | Kajiyama | 187/29 R |

*Primary Examiner*—J. V. Truhe
*Assistant Examiner*—Paul Shik Luen Ip
*Attorney, Agent, or Firm*—D. R. Lackey

[57] ABSTRACT

An elevator system in which indicia in the hatchway to signal elevator car slowdown points for the floors of a building are also used to maintain and update the advanced car position. The advanced car position is changed to the next floor in the car's travel direction at the start of a run, and then each slowdown indicia encountered by the car associated with the car travel direction changes the advanced car position until the slowdown indicia is detected which is associated with the floor at which the elevator car is to stop.

2 Claims, 6 Drawing Figures

ELEVATOR SYSTEM

BACKGROUND OF THE INVENTION

1. Field of the Invention

The invention relates in general to elevator systems, and more specifically, to new and improved methods and apparatus for determining and maintaining the advanced car position of an elevator car.

2. Description of the Prior Art

In relatively low speed elevator systems, such as under 500 fpm, it is common to utilize indicia in the hatchway which cooperate with electrical switches mounted on the car. The indicia serve as switch actuators when the elevator car passes the various indicia. Examples of such switch/actuator arrangements include (a) an arrangement for producing a light beam which is interrupted by an actuator, (b) mechanical switches with cam followers which are operated by a cam actuator, (c) a magnetic switch in the form of an inductor relay, with the inductor relay having an incomplete magnetic circuit which is completed by an actuator in the form of a plate or vane constructed of magnetic material, (close proximity of the magnetic switch and vane completes the magnetic circuit to operate the switch) and, (d) magnetic switches, such as reed switches, which are operated from one position to another position while being subjected to a magnetic field, such as from a permanent magnet actuator.

U.S. Pat. No. 3,856,116 illustrates a cam/switch arrangement, U.S. Pat. No. 3,889,231 illustrates a magnet/switch arrangement, and application Ser. No. 171,788, filed July 24, 1980, now U.S. Pat. No. 4,322,703, discloses a magnetic plate/switch arrangement, all of which are assigned to the same assignee as the present application.

The usual control functions provided by these switch/actuator arrangements include (a) detection of the arrival of the elevator car at a point relative to a target floor where slowdown should be initiated, (b) detection of the arrival of the elevator car at a point relative to the target floor where stopping should be initiated, and (c) detection of the car passing locations relative to the floors where the advanced car position AVP is incremented, or decremented, depending upon car travel direction. These actuators for implementing these functions are normally disposed in five vertical lanes in the hatchway. For example, function (a) requires one vertical lane, such as for mounting landing cams, which are also used for releveling, function (b) requires two vertical lanes for establishing slowdown distances relative to the floor, for each travel direction from which the floor can be approached, and function (c) requires two vertical lanes for alternately notching the floor selector from two switches, to prevent contact bounce from falsely notching or changing the advanced car position. U.S. Pat. No. 3,902,572, which is assigned to the same assignee as the present application, describes these functions in detail. The advanced car position is defined as the floor at which the stationary car is sitting, and the closest floor to the moving car at which the car can make a normal stop.

Each vertical lane of indicia in the hoistway adds substantially to the initial cost, as well as to the maintenance costs, of an elevator system, and thus it would be desirable to reduce the number of vertical lanes of indicia, and their associated switches, if such the reduction can be accomplished without loss of function.

SUMMARY OF THE INVENTION

Briefly, the present invention relates to new and improved methods and apparatus for maintaining the advanced car position AVP of an elevator car. The invention eliminates the need for two vertical lanes of indicia which are used in the prior art to maintain the advanced car position, with this function being performed by the indicia in the hatchway which is also used for initiating the slowdown function. When an elevator car prepares to make a run, the invention advances the AVP immediately, with it being changed to the next adjacent floor to the elevator car in the selected travel direction. When a slowdown cam, or other indicia for this next floor is detected, slowdown is initiated if the detected indicia is associated with the target floor, i.e., the next floor in the car's travel direction where a stop is to be made. If the detected indicia is not associated with the target floor, the advanced car position AVP is notched or changed to the next floor in the car's travel direction.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Briefly, the new and improved method of operating an elevator system immediately changes the car's advanced car position AVP at the start of a run, and then a decision is made each time slowdown indicia associated with the car's travel direction is encountered. If the slowdown indicia is associated with the target floor, slowdown is initiated, and if not, the AVP is changed one floor in the car's travel direction. The new and improved apparatus for implementing this method will now be described.

Figure 1:
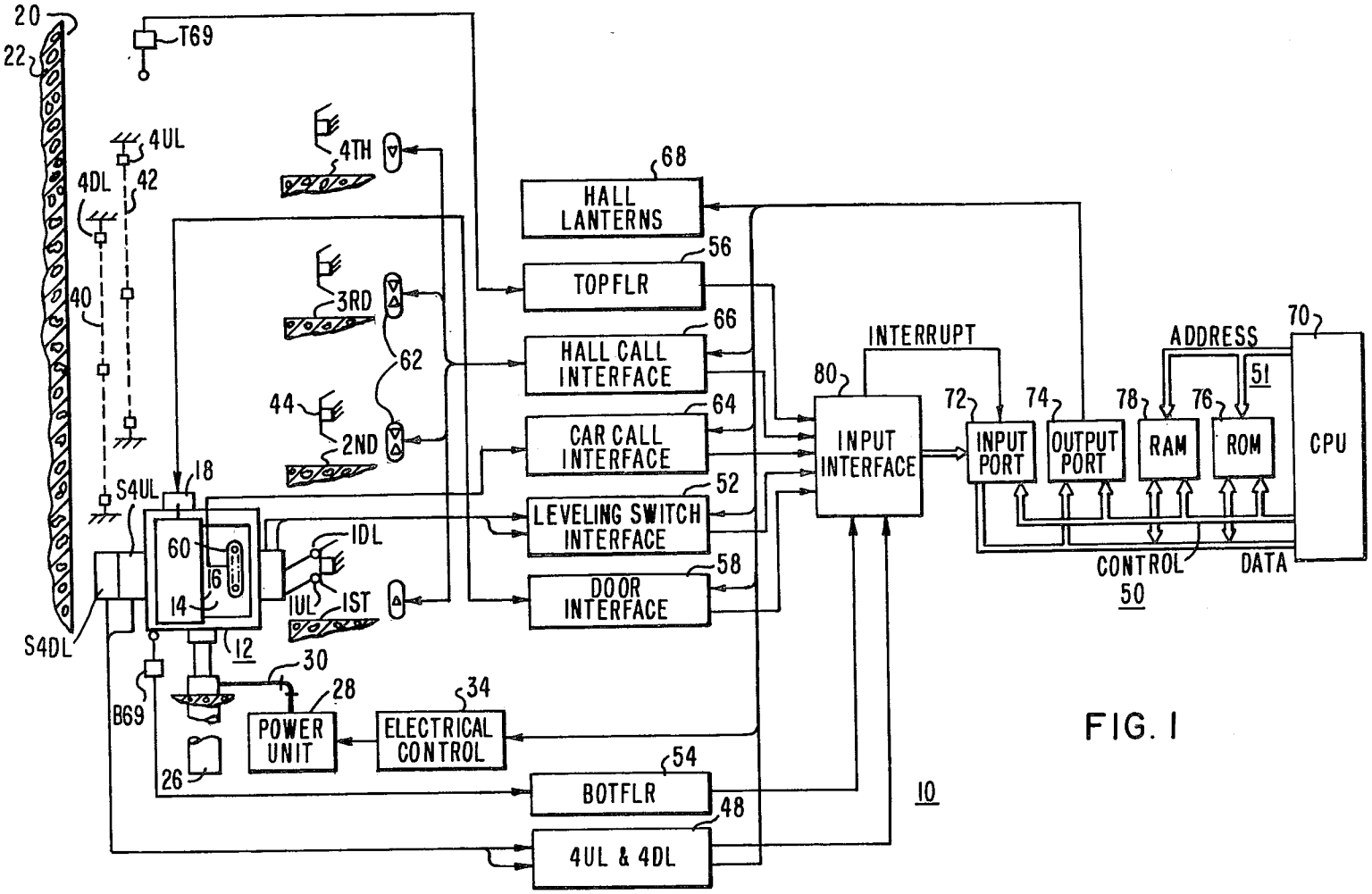
FIG. 1 is a schematic diagram of an elevator system constructed according to the teachings of the invention.

FIG. 1 is a schematic diagram of an elevator system 10 constructed according to the teachings of the invention. Elevator system 10 may be a hydraulic elevator, or a relatively slow speed electric traction elevator. For purposes of example, a hydraulic elevator system will be described. Elevator system 10 includes an elevator car 12 comprising a passenger cab mounted on a sling and platform assembly. Car 12 defines a passenger compartment, which has an opening 14, a door 16 for the opening, and a door operator 18 which slidably operates door 16 between the open position illustrated in FIG. 1, and a closed position.

Elevator car 12 is mounted for guided movement in the hoistway 20 of a structure or building 22 having floors to be served by the elevator car 12, such as the four floors shown in FIG. 1. The floors each include a hoistway door (not shown), which is operated in unison with the car door 16 when the elevator car 12 is located at a floor. Elevator car 12 is guided and stabilized in its vertical travel path via guide rails (not shown), which are suitably attached to the walls of the hoistway 20 via rail brackets, and guide roller assemblies (not shown) on the elevator car 12 which co-act with the guide rails. Motive means for elevator car 12 includes a hydraulic system comprising a jack assembly 26, a hydraulic power unit 28, suitable piping 30 which provides fluid flow communication between the power unit 28 and jack assembly 26, and electrical control 34 for the power unit 28. The power unit 28, which may be conventional, includes a reservoir of hydraulic oil, a pump, an electric motor for operating the pump, and an elevator valve. The electrical control 34 includes a line starter for the electric motor, and controls for operating the elevator valve. The elevator valve typically includes up level, up stop, down level, and down stop solenoids, as well as check and relief valves.

In a typical up cycle operation, the motor pump unit and the up level and to stop solenoids in the elevator valve are energized to deliver hydraulic oil under pressure to jack 26 to provide rated car speed in the up travel direction. As the elevator car 12 nears the target floor, i.e., the floor at which it is to stop, hatch switches S4Ul and 1DL sequentially deenergize the up level and up stop solenoids to stop the car at floor level. The pump is then deenergized shortly after the car stops at the floor. Should the car creep below floor level, switch 1UL will come off the leveling cam and reenergize the pump and the up stop solenoid, to return the car to floor level.

A down travel cycle returns hydraulic oil to the reservoir, with both the down level and down stop solenoids in the elevator valve being energized to provide rated speed in the downward travel direction. The pumpmotor unit is not actuated in the down travel direction. Hatch switches S4DL and 1UL sequentially deenergize the down level and down stop solenoids to stop the elevator car 12 level with the desired target floor. Reference may be made to application Ser. Nos. 110,280 and 219,100, filed Jan. 7, 1980 and Dec. 22, 1980, respectively, which applications are assigned to the same assignee as the present application, if a more detailed description and schematic drawings of a hydraulic elevator system are desired.

Switches S4DL and S4UL are mounted on elevator car 12, and they are actuated by indicia 4DL and 4UL, respectively, mounted in hatchway 20 in first and second vertical lanes indicated by broken lines 40 and 42, respectively. The broken lines 40 and 42, for example, may indicate metallic tape strung in the hatchway, to which the indicia is attached, or any other suitable mounting means. Indicia 4DL is associated with each floor which may be approached by a down traveling car, and each indicia is located such that switch S4DL will detect the indicia when the elevator car is a predetermined distance from the floor associated with the indicia. This predetermined distance depends upon the rated speed of the elevator car 12, such as between 5 inches and 40 inches for speeds of 25 FPM to 200 FPM.

In like manner, the 4UL indicia is associated with each floor which may be approached by an up traveling elevator car, with the positioning of the indicia being determined in a manner similar to that described for the 4DL indicia.

Switches 1DL and 1UL mounted on the car 12 cooperate with cams, or other suitable indicia in the hatchway 20, such as the cams 44 shown in FIG. 1 associated with each floor. The cams 44 are located such that when the elevator car 12 is at floor level, both switches 1DL and 1UL will be actuated. If the car should overshoot the floor in the up travel direction, switch 1DL will come off the cam 44 and initiate down releveling. If the car should pass the floor level in the down travel direction, or if it creeps downwardly from floor level, switch 1UL will come off cam 44 and initiate up releveling.

When switches S4DL and S4UL are actuated, an interface 48 translates the actuation into a logic level signal, such as a logic one signal, if the actuated switch has been enabled by the car controller 50. Switch S4UL may be enabled by the car controller 50 when car 12 is set for up travel, and switch S4DL may be enabled by controller 50 when car 12 is set for down travel; or, the enabling may be automatically accomplished by the manner in which the operating program is set up and run, as desired.

When switches 1DL and 1UL are actuated, an interface 52 translates the actuations to logic level signals, such as a logic one signal during actuation.

Switches B69 and T69, along with their respective interfaces 54 and 56, provide true logic signals BOTFLR and TOPFLR, respectively, when the elevator car 12 is at the lower and upper terminal floors, respectively. Door operator 18 provides a true logic signal 40R via door interface 58 when the car doors 16 are closed.

Elevator car 12 is controlled in response to calls for elevator service, such as may be initiated via car call pushbuttons 60 mounted in a car station in the elevator car 12, and via up and down hall call pushbuttons, shown generally at 62, which are located in the hallways of the various floors. The car calls are translated to logic level via car call interface 64, and the up and down hall calls are translated to logic level via hall call interface 66.

Up and down direction hall lanterns, shown generally at 68, are controlled by the car controller 50.

Car controller 50 includes a floor selector function, keeping track of car position via the car position translating switches, and also keeping track of the calls for elevator service. Car controller 50 may be implemented by a microprocessor 51, which includes a central processing unit or CPU 70, an input port 72, an output port 74, a read-only memory or ROM 76, and a random-access memory or RAM 78.

Controller 50 also includes an input interface 80 for storing car status information from the car 12, with the interface 80 being periodically read by the microprocessor 51. Input interface 80 includes an interrupt line for interrupting microprocessor 51 when a slowdown indicia 4UL or 4DL is detected while the car 12 is traveling up or down, respectively. The signal developed when a stopping or leveling cam 44 is first detected following the detection of a slowdown indicia for the target floor is simply one of the input signals which is examined on each running of the program.

Figure 2:
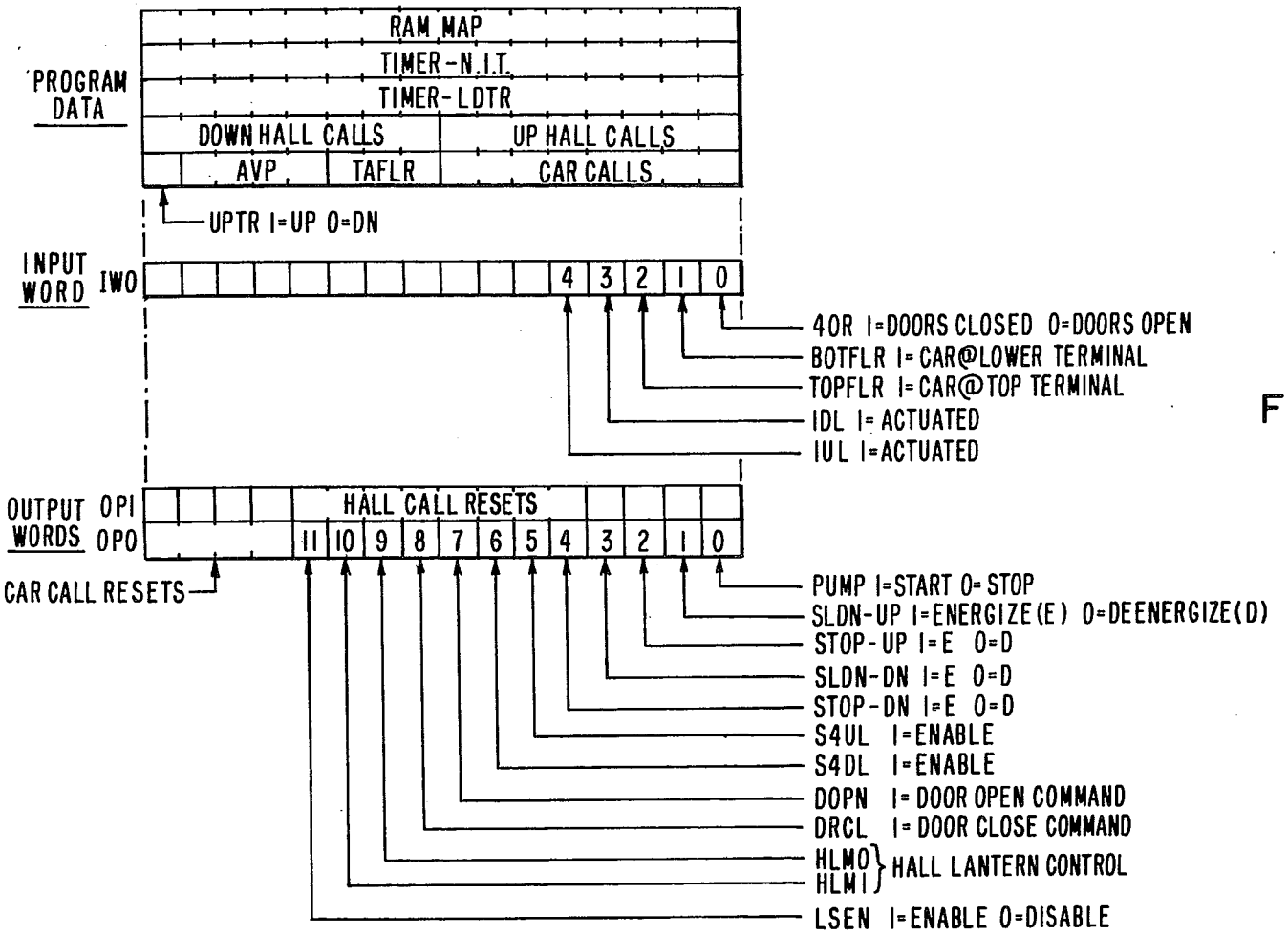
FIG. 2 is a RAM map illustrating suitable formats for storing input data or words indicative of the status of the elevator car, output data or words which include commands for controlling the operation of the elevator car and related functions, and program data or words generated by the operating program during the supervision and control of the elevator car.
Figure 3A:
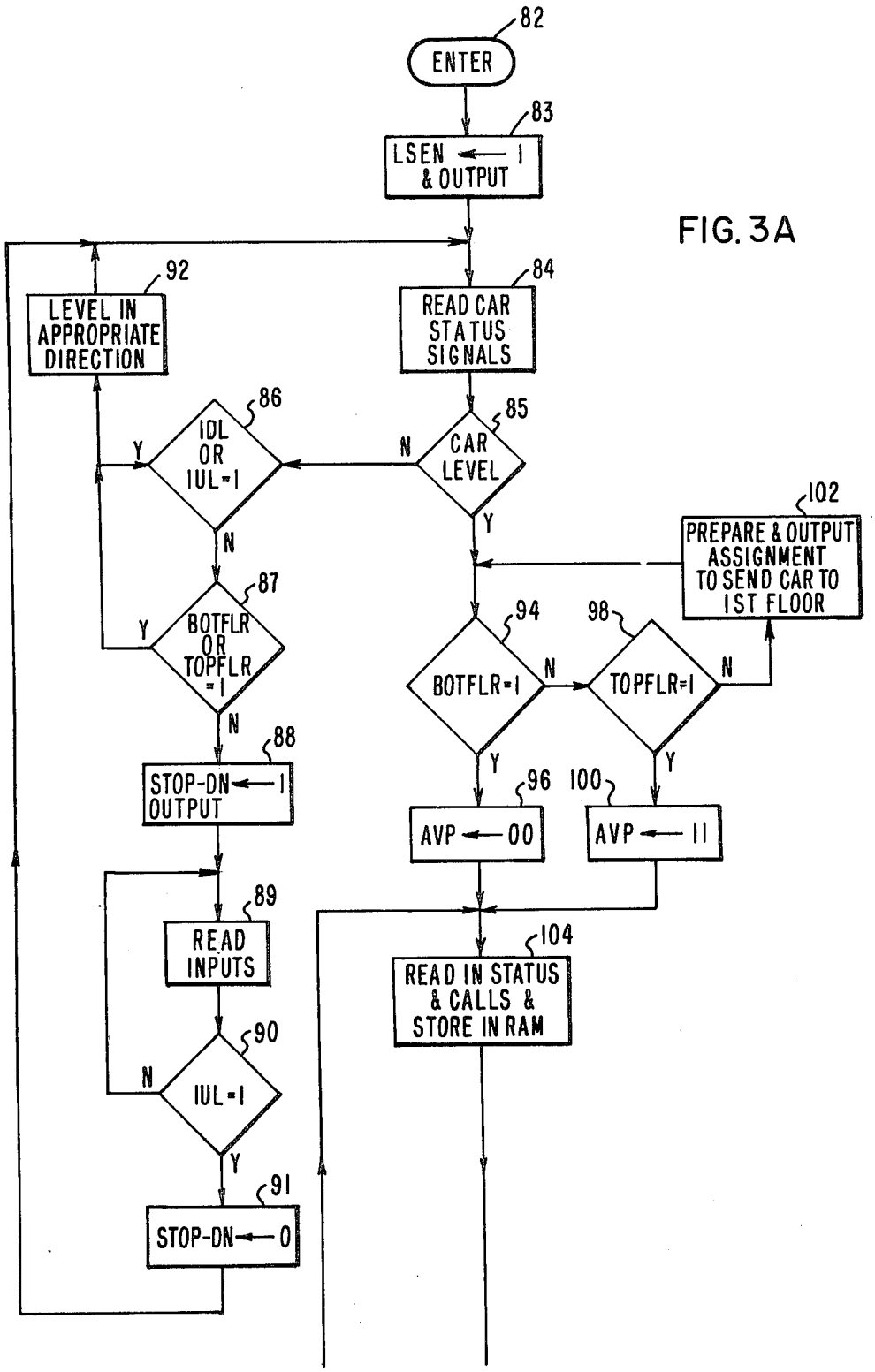
FIGS. 3A and 3B may be assembled to provide a detailed flow chart of an operating program which is run by the elevator system shown in FIG. 1, with this program being constructed according to the teachings of the invention.
Figure 3B:
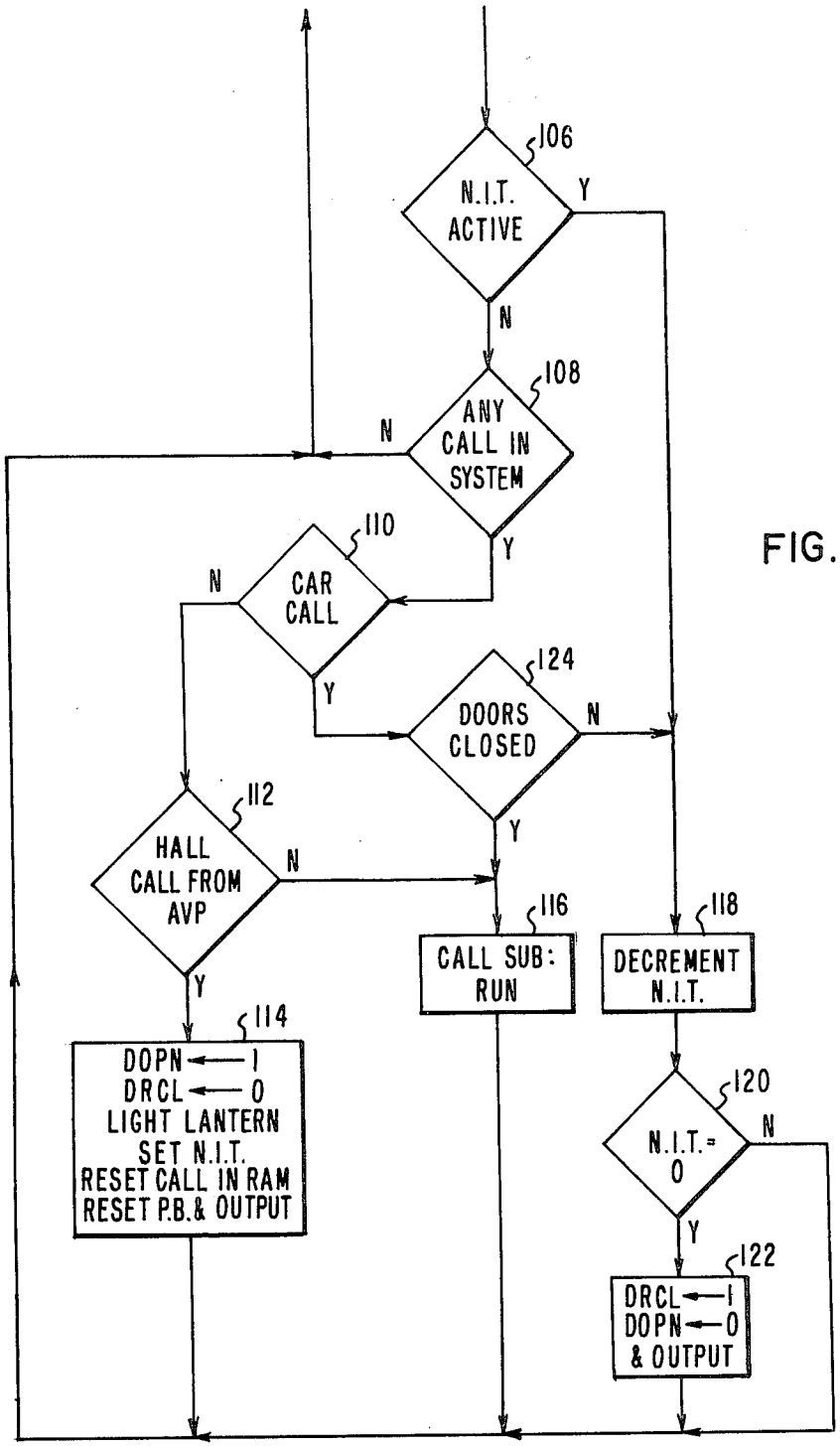

FIG. 2 is a RAM map illustrating suitable formats for storing certain information in RAM 78, and FIGS. 3A and 3B may be assembled to provide a detailed flow chart of a program which implements the floor selector function. The program is stored in ROM 76. FIG. 2 will be referred to during the following description of the operating program set forth in FIGS. 3A and 3B.

More specifically, when the elevator system 10 is first started after power has been removed, it is necessary to synchronize the floor selector function with actual car position, i.e., to set the advanced car position AVP correctly in controller 50. Normally, the elevator car 12 will be parked at the lower terminal floor. When the program is entered at 82, step 83 enables the landing switches 1UL and 1DL by setting the landing switch enable signal LSEN to a logic one at bit 11 of OPO, shown in FIG. 2. This enabling may also be accomplished automatically, if desired, by structuring the program to only check 1UL and 1DL when the car is supposed to be in the landing zone. Step 83 outputs the enable via its output port 74 to the leveling switch interface 52. Step 84 reads in the car status signals, i.e., input word IWO, from interface 80. Step 85 checks to see if the car 12 is at floor level. If it is, both switches 1DL and 1UL will be actuated. If both switches 1DL and 1UL are not actuated, step 86 checks to see if one of these switches is actuated, which would place the car in a landing zone relative to a floor, if only one of these switches is actuated. The landing zone may be a three or four inch zone, for example. If neither of these switches is actuated, step 87 checks signals BOTFLR and TOPFLR in IWO. If either is a logic one, the car 12 is in a terminal zone, which may be a six inch zone, for example. If neither of these signals is a logic one, car 12 is not in a landing zone, or in a terminal zone. Car 12 is then sent, at leveling speed, to a floor, such as the next adjacent floor in the down travel direction. For example, step 88 sets signal STOP-DN and it outputs this signal via output port 74 to control 34, which energizes the down stop solenoid. When the down stop solenoid is energized, the car travels downwardly at leveling speed. Step 89 reads the car status signals, and step 90 looks for switch 1UL changing from a logic zero to a logic one, which will occur when switch 1UL encounters a landing cam 44. The program loops through steps 89 and 90 until switch 1UL provides a true signal, at which point step 91 resets signal STOP-DN. The down stop solenoid is thus deenergized, stopping the car, and the program returns to step 84.

If step 86, or step 87, found the elevator car in a landing zone, or a terminal zone, respectively, step 92 sets the car to travel in the appropriate direction, at leveling speed, by repeating steps similar to steps 88 through 91. Step 92 then returns to step 84.

Step 85 will now find car 12 at floor level, and step 94 checks to see if the car 12 is in the lower terminal zone. If it is, signal BOTFLR will be a logic one, and step 94 checks the logic level of this signal at bit position 1 of input word IWO. If step 94 finds BOTFLR true, the program advances to step 96 which sets the advanced car position AVP to the binary address of the lower terminal floor, i.e., 00. The advanced car position AVP is stored in RAM 70, as illustrated in the format shown in FIG. 2. If step 94 does not find car 12 in the lower terminal zone, step 98 checks bit position 2 of IWO to see if the car is in the upper terminal zone. If it is, signal TOPFLR will be true. If the car 12 is in the upper terminal zone, step 100 sets AVP to 11, the binary address of the upper or fourth floor. If step 98 does not find the car in the upper terminal zone, step 102 prepares and outputs an assignment to send car 12 to the lower terminal floor. Once the car is located at the lower terminal floor and signal BOTFLR is true, as checked in step 94, step 96 will set AVP to 00.

Step 104 then reads the car status signals, car calls and hall calls and stores them in RAM 78, such as in the format shown in FIG. 2. Step 106 checks to see if the door non-interference time N.I.T. is active, which, on the initial run through the program will be inactive. Step 108 then checks to see if there is any call, car call or hall call, in the system, by checking the call tables in RAM 78 for a set bit. If there are no calls in the system, the program loops back to step 104, and it remains in this loop, which includes steps 104, 106 and 108, awaiting a call.

When step 108 finds a call, step 110 checks to see if there is a car call in the system. On this run through the program, it will be assumed that the car is parked at a floor with its doors closed, and thus there should be no car calls. Step 112 then checks to see if it is a hall call registered from the floor where the car 12 is sitting, i.e., a hall call registered from the floor of the AVP. If the hall call is from the AVP, step 114 prepares the output words shown in FIG. 2 to provide predetermined commands for the car 12. For example, it sets bit 7 of output word OP0 to a logic one, which provides a true door open signal DOPN, it zeros bit position 8, which removes the door close command DRCL, it prepares bits 9 and 10, which are the hall lantern mode bits HLM0 and HLM1, to turn on the appropriate hall lantern, or lanterns, at the floor of the car, it sets a bit in output word OP1 to reset the hall call pushbutton, it resets the call in the hall call table in RAM 78, and it loads a predetermined binary count into RAM 78, into the N.I.T. position, corresponding to the door non-interference time. The output words are then sent to the output port 74 and from there to the door interface 58, hall call interface 66, and the hall lanterns 68. The program then returns to step 104.

Figure 4A:
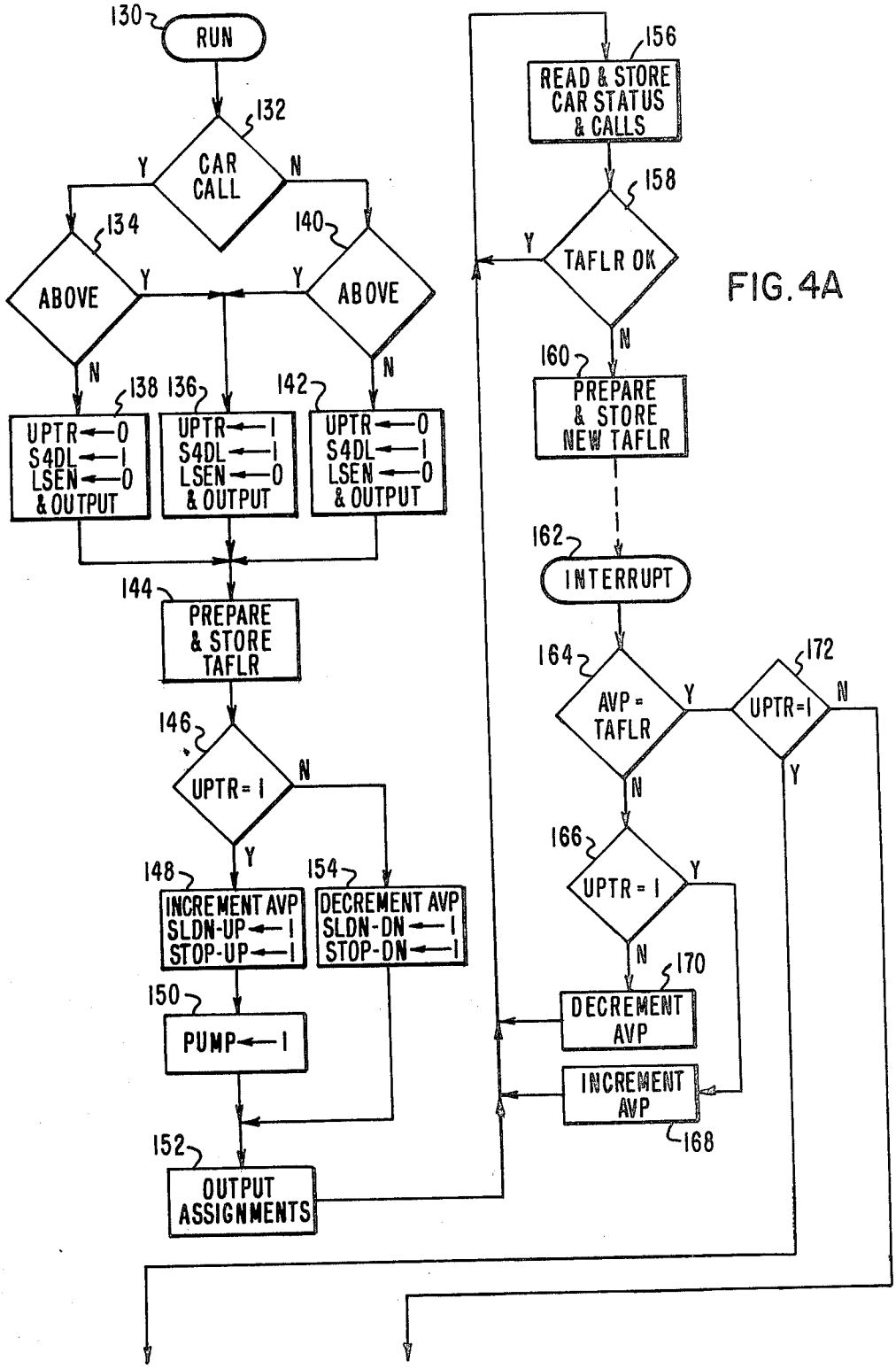
FIGS. 4A and 4B may be assembled to provide a subroutine called by the operating program shown in FIGS. 3A and 3B, when the elevator car shown in FIG. 1 is to make a run.
Figure 4B:
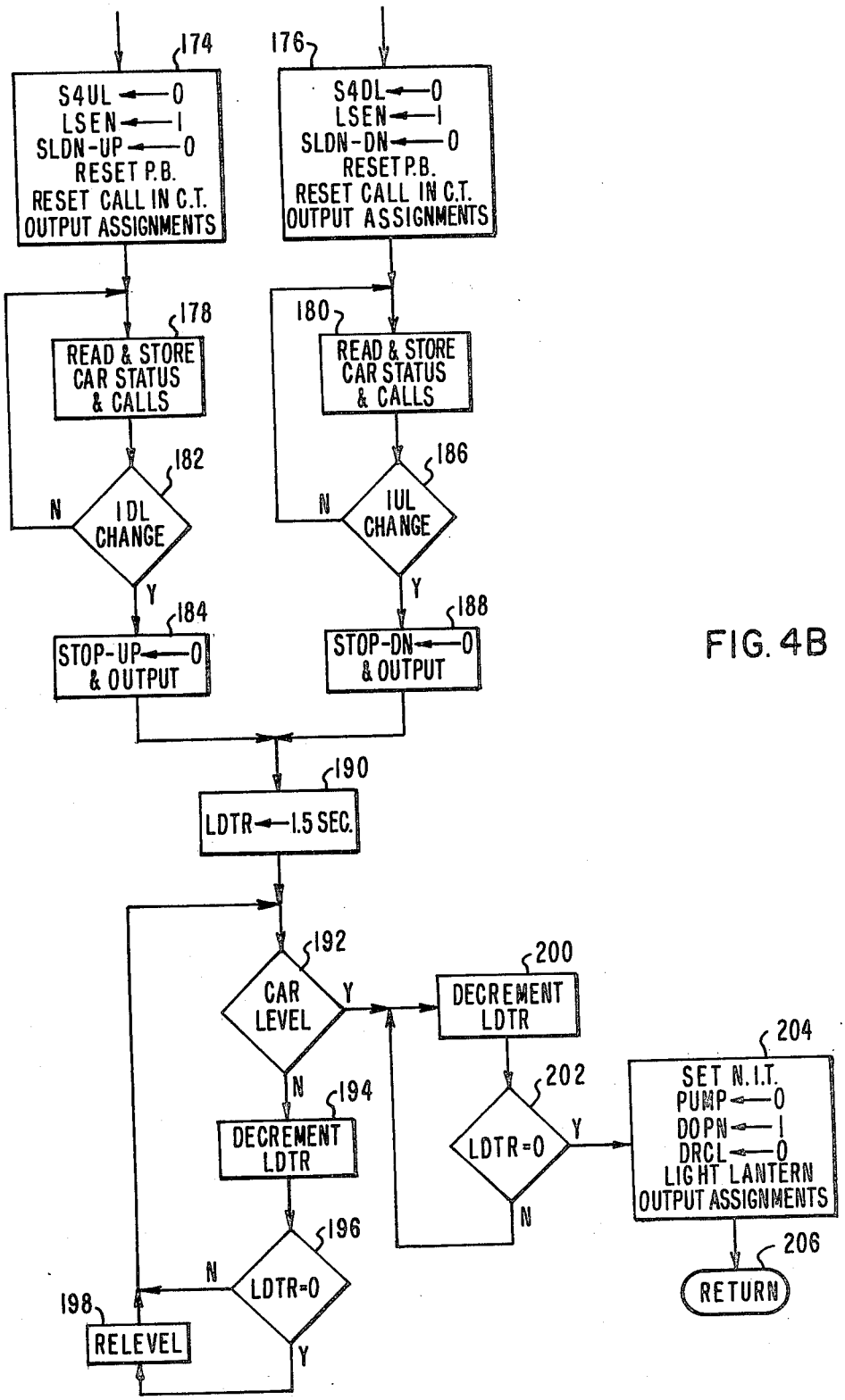

If step 112 found that the hall call was not from the AVP floor, the program advances to step 116 which calls a subroutine RUN. Subroutine RUN, which is shown in detail in FIGS. 4A and 4B, will be hereinafter described.

It will be assumed that step 112 found the hall call to be registered from the AVP floor. The next time step 106 is encountered, the N.I.T. will be found to be non-zero, i.e., active, and step 118 decrements the stored N.I.T. count, to thus cause the stored count to function as a timer. Step 120 checks to see if the N.I.T. count is zero, and if it is not, the program returns to step 104. The program loops through steps 104, 106, 118 and 120 until the door non-interference time expires, at which time step 120 branches to step 122 to prepare the commands which cause the car doors to close, i.e., DRCL is set, and DOPN is reset. These commands are then sent to the door interface.

If the prospective passenger who registered the hall call has now entered the car 12 and placed a car call, steps 104 and 106 will advance to step 108 which finds a call in the system, and step 110 will find a car call in the system. Step 110 branches to step 124 to see if the doors are closed, by checking bit 0 of input word IW0. If this bit, signal 40R is a zero, the doors are not yet closed, and step 124 goes into a loop which includes steps 118, 120, 104, 106, 108 and 110, until the doors are found to be closed, at which point step 124 goes to step 116 to call the subroutine RUN.

FIG. 4 sets forth a detailed flow chart for the subroutine RUN. Subroutine RUN is entered at 130, and step 132 checks to see if there is a car call registered. If so, it has direction preference over hall calls, and step 132 advances to step 134 to determine if this car call is for a floor above, or for a floor below, the AVP. If above, step 134 goes to step 136 which sets the car for up travel, by setting signal UPTR in RAM 78, it enables switch S4UL by setting bit position 5 of OP0 in RAM 78, and it disables the landing switches by resetting bit 11 of OP0, which is the position for the landing switch enable signal LSEN. Step 138 is similar to step 136, except for a car call below.

If step 132 found no car calls, the call is a hall call, and step 132 branches to step 140 to check the call floor versus AVP. If the call floor is above the AVP, step 140 goes to step 136, and if the call floor is below the AVP, it goes to step 142, which may be the same as step 138.

Steps 136, 138 and 142 all advance to step 144 which prepares and stores the target floor TAFLR. It does this by determining the closest floor to the current car position at which the car should make a stop in the selected travel direction. The target floor address in binary is stored in RAM 78, such as in the format shown in FIG. 2.

After step 144 prepares TAFLR, it advances to step 146 to check signal UPTR for the previously assigned car travel direction. If UPTR is a logic one, step 148 increments AVP and it sets signals SLDN-UP and STOP-UP, bits 1 and 2 of OW0, which will energize the up level and up stop solenoids, respectively, when the signals are output to the control 34. Step 150 sets signal PUMP, bit 0 of OP0, and step 152 outputs the assignments to control 34. Signal PUMP starts the motor-pump combination in the power unit 28, and signals SLDN-UP and STOP-UP energize the up level and up stop solenoids, respectively, to initiate the acceleration of the elevator car 12 to contract speed in the up travel direction.

If step 146 finds signal UPTR to be a logic zero, it branches to step 154, which decrements AVP, and it also sets SLDN-DN and STOP-DN, bits 3 and 4 of OW0. Step 154 then advances directly to step 152, as the pump is not energized during down travel.

Thus, at the very start of a run, the car's AVP is incremented, or decremented, to the next floor to the car's present position, in the direction the car will travel.

Step 152 advances to step 156, which reads the input port 72 and stores car status signals and calls in RAM 78, and step 158 checks to see if the target floor TAFLR should be changed. In other words, if a call ahead of the car should be registered from a floor between the AVP and TAFLR, requesting service for the same travel direction as the car, the target floor should be changed to this closer floor. Step 160 prepares the new TAFLR, if step 158 finds this to be necessary. Steps 158 and 160 both return to step 156, and the program remains in this loop until an interrupt occurs. This loop may also include the steps of setting and decrementing an antistall timer, if desired, to escape the loop and initiate some auxiliary strategy, should the car fail to respond normally within a predetermined period of time.

When the car passes a slowdown indicia in the vertical lane associated with the enabled switch, i.e., 4UL, when switch S4UL is enabled, and 4DL when switch S4DL is enabled, input interface 80 generates an interrupt, indicated at 162 in FIG. 4. Step 164 then compares the AVP with TAFLR, to see if the detected indicia is associated with the target floor. If it is not, step 166 checks the car travel direction signal UPTR, with step 168 incrementing AVP when the travel direction is up, and with step 170 decrementing AVP when the travel direction is down. Steps 168 and 170 both return to step 156 and the loop which includes steps 156, 158 and 160. When the indicia associated with the target floor is detected, step 164 branches to step 172 which checks the car travel direction signal UPTR. If the car travel direction is up, step 174 initiates slowdown of the elevator car, and it resets the call being answered. It initiates slowdown by resetting signal SLDN-UP, which, when sent to control 34, will deenergize the up level solenoid. It enables the landing switches 1DL and 1UL by setting the enable signal LSEN. It resets the call being answered by removing it from the call table in RAM 78, and by setting the appropriate bit in the call reset table, also in RAM 78. When the reset bit is sent to the appropriate pushbutton, it will deenergize its lamp. Step 174 also disables switch S4UL, and it outputs signal SLDN-UP and the call reset signal to its output port 74, and from there to control 34 and the appropriate pushbutton.

In like manner, when step 172 finds the travel direction to be down, step 176 initiates slowdown in the down travel direction by resetting signal SLDN-DN, and setting the landing switch enable signal LSEN. It also removes the call from the call table, and resets the pushbutton which registered the call. Switch S4DL is disabled by resetting signal S4DL.

Step 174 goes into a loop which includes step 178, which reads and stores the input signals and calls. This loop does not change the target floor TAFLR, as the car is now in the process of stopping at a previously selected target floor. Step 178 may also set and decrement an antistall timer, set slightly greater than the normal time for the car to travel from the slowdown indicia to the leveling or stopping indicia. In like manner, when the car is traveling down, and slowdown is initiated in step 176, step 176 proceeds into a loop which includes step 180.

When car 12 is traveling up, and it reaches the landing zone of the target floor, switch 1DL is actuated by the landing indicia or cam 44, which is detected by step 182. Step 184 initiates stopping by resetting signal STOP-UP, which, when the signal is applied to control 34, deenergizes the up-stop solenoid to stop the car.

When car 12 is traveling down, the actuation of switch 1UL breaks the program out of the loop, indicated at step 186, and step 188 initiates stopping by resetting signal STOP-DN, and by outputting it to control 44. This deenergizes the down stop solenoid, to stop the car.

It is preferable to stop the car on the elevator valve, as it cushions the stop. The pump, on an up run, is deenergized about 1.5 seconds after the up stop solenoid is deenergized. This may be accomplished by step 190, which loads memory location LDTR in RAM 78 with a count representing 1.5 seconds. Step 192 checks to see if the car is level, by checking bits 3 and 4 of input word IW0. When level, both switches 1DL and 1UL will be in their actuated conditions. If car 12 is not level, step 194 decrements count LDTR and step 196 checks to see if the LDTR time has expired. If it has, step 198 initiates releveling. If the car needs to travel upwardly to get to floor level, step 198 starts the pump by setting the signal PUMP, if the car had been traveling in the downward direction, it sets STOP-UP to cause the car to travel upwardly at leveling speed, and when both signals 1DL and 1UL are at the logic one level, signals PUMP and STOP-UP will both be reset to logic zero.

When step 192 finds the car at floor level, step 200 decrements count LDTR and step 202 checks to see if the time has expired. If it has not, step 202 returns to step 200 until step 202 finds the time has expired. Step 204 then sets the door non-interference time N.I.T., it stops the pump by resetting signal PUMP, it sets signal DOPN, it resets signal DRCL, it prepares the appropriate hall lantern assignment, using mode bits HLM0 and HLM1, it outputs the assignments, and then it returns to the main program at 206. A suitable format for using the hall lantern mode bits is shown in Table I of U.S. Pat. No. 3,804,209, which is assigned to the same assignee as the present application.

In summary, there has been disclosed new and improved methods and apparatus for determining and maintaining the advanced car position AVP of an elevator car, by making dual use of hatchway indicia which provide only a single function in prior art elevator systems. The invention eliminates the need for two vertical lanes of indicia in the hatchway, as well as the switches which cooperate with these vertical lanes, reducing the initial cost and maintenance cost of the elevator system.

We claim as our invention:

1. An elevator system, comprising:

a structure having a plurality of floors and a hatchway, an elevator car mounted for movement in said hatchway, motive means for moving said elevator car relative to the structure, to serve said floors, call registering means for registering calls for elevator service, travel direction means for establishing a car travel direction in response to a call for elevator service, target floor means for determining the floor at which the elevator car is to stop, advanced car position means for maintaining the advanced car position of the elevator car, said advanced car position only being the same as the actual car position when the car is stationary and when the car is in the process of stopping at a target floor, otherwise being one floor ahead of the actual car position, to always signify the floor at which the car can make a normal stop, first and second vertical lanes of indicia mounted in said hatchway, with each lane having a single indicium associated with each floor, said first and second lanes providing the dual functions of: (a) indicating elevator car slowdown points for the floors in the up and down travel directions, respectively, when the associated floor is a target floor, and (b) indicating that the advanced car position means should change the advanced car position, when the associated floor is not a target floor, a single detector on said elevator car for each of said first and second lanes, with each detector detecting the indicia in its associated lane, means responsive to car travel direction at the start of a run for changing the advanced car position means to the next adjacent floor in the car travel direction, said advanced car position means being responsive to said detector means and to said target floor means when the car is moving, changing the advanced car position in response to the detection of each indicium in the lane associated with car travel direction not associated with the target floor, and means responsive to said detector means and said target floor means for initiating slowdown of the elevator car when said detector means detects the indicium associated with the target floor.

2. A method of maintaining the advanced car position of an elevator car from the same indicia which signify the slowdown points for the floors of a building, with each floor having a single slowdown indicium for each travel direction, comprising the steps of:

detecting the need to start the elevator car, determining the travel direction in response to the detection of the need to start, determining a target floor at which the elevator car is to stop, changing the advanced car position from the actual car position to the next floor in the determined travel direction, moving the elevator car in the determined travel direction, providing first and second vertical lanes of slowdown indicium for the up and down travel directions, respectively, with each lane having a single indicium for each floor, providing a single sensor for each of said first and second vertical lanes, detecting the slowdown indicium with the sensor associated with the determined travel direction, for the next floor in the determined travel direction, initiating slowdown of the elevator car when a detected slowdown indicium is associated with the target floor, and changing the advanced car position to the next floor in the determined travel direction when the detected slowdown indicium is not associated with the target floor.

* * * * *